US006184845B1

(12) United States Patent
Leisten et al.

(10) Patent No.: US 6,184,845 B1
(45) **Date of Patent: *Feb. 6, 2001**

(54) DIELECTRIC-LOADED ANTENNA

(75) Inventors: Oliver Paul Leisten; Ebinotambong Agboraw, both of Kingsthorpe (GB)

(73) Assignee: Symmetricom, Inc., San Jose, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/889,998

(22) Filed: Jul. 10, 1997

(30) Foreign Application Priority Data

Nov. 27, 1996 (GB) ..... 9624649
May 9, 1997 (GB) ..... 9709518

(51) Int. Cl.[7] ..... H01Q 1/36
(52) U.S. Cl. ..... 343/895; 343/821; 343/859
(58) Field of Search ..... 343/895, 700 MS, 343/702, 752

(56) References Cited

U.S. PATENT DOCUMENTS

| | | | | |
|---|---|---|---|---|
| 4,008,479 | | 2/1977 | Smith | 343/873 |
| 5,134,422 | * | 7/1992 | Auriol | 343/895 |
| 5,255,005 | | 10/1993 | Terret et al. | 343/895 |
| 5,346,300 | * | 9/1994 | Yamamoto et al. | 343/895 |
| 5,349,365 | * | 9/1994 | Ow et al. | 343/895 |
| 5,612,707 | * | 3/1997 | Vaughan et al. | 343/895 |
| 5,859,621 | * | 1/1999 | Leisten | 343/895 |

FOREIGN PATENT DOCUMENTS

| | | | |
|---|---|---|---|
| 0 791 978 A2 | 8/1997 | (EP) . | |
| 2 292 638 | 8/1995 | (GB) . | |
| 2292257 | 2/1996 | (GB) . | |
| 2292638 | 2/1996 | (GB) . | |
| 2 310 543 | 8/1997 | (GB) | H01Q/11/08 |
| 2 311 675 | 10/1997 | (GB) . | |
| 2 317 057 | 3/1998 | (GB) | H01Q/1/36 |
| 9606468 | 2/1996 | (WO) . | |

OTHER PUBLICATIONS

G.B. Application No. 9709518.6, Search Report dated Jul. 29, 1997.
G.B. Application No. 9624649.1, Search Report dated Feb. 25, 1997.
PCT/GB97/03217—International Search Report dated Feb. 10, 1998.

* cited by examiner

*Primary Examiner*—Don Wong
*Assistant Examiner*—James Clinger
(74) *Attorney, Agent, or Firm*—Wilson Sonsini Goodrich & Rosati

(57) ABSTRACT

A dielectric-loaded loop antenna for operation at frequencies above 200 MHz has an elongate cylindrical core with a relative dielectric constant greater than 5, a pair of co-extensive helical antenna elements, a coaxial feeder structure extending through the core from a proximal end to a distal end where it is coupled to the antenna elements, and a balun formed on the core cylindrical surface and connected to the feeder structure at the proximal end of the core. Each helical antenna element is bifurcated at an intermediate position so that proximally, it is formed of two generally parallel branches each of which is coupled to a respective linking path around the core to meet a corresponding branch of the other elongate element therefore forming a conductive loop between the two conductors of the feeder structure. The two conductive loops have different electrical lengths as a result of, for example, the branches being of different lengths. In a preferred embodiment, the linking paths around the core are formed by the rim of a split conductive sleeve constituting the balun. The sleeve is formed in two parts separated by a pair of longitudinally extending diametrically opposed quarter wave slits each of which extends from the space between the branches of a respective helical antenna element to a short circuited end adjacent the proximal end of the core.

42 Claims, 5 Drawing Sheets

DIELECTRIC-LOADED ANTENNA

FIELD OF THE INVENTION

This invention relates to dielectric-loaded antenna for operation at frequencies in excess of 200 MHz, and having a three-dimensional antenna element structure on or adjacent the surface of an elongate dielectric core which is formed of a solid material having a relative dielectric constant greater than 5.

BACKGROUND OF THE INVENTION

An antenna as described above is known from published UK Patent Application No. GB 2292638A which discloses a quadrifilar antenna having an antenna element structure with four helical antenna elements formed as metallic conductor tracks on the cylindrical outer surface of a cylindrical ceramic core. The core has an axial passage with an inner metallic lining and the passage houses an axial feeder conductor, the inner conductor and the lining forming a coaxial feeder structure for connecting a feed line to the helical antenna elements via radial conductors formed on the end of the core opposite the feed line. The other ends of the antenna elements are connected to a common virtual ground conductor in the form of a plated sleeve surrounding a proximal end portion of the core and connected to the outer conductor of the coaxial feeder formed by the lining of the axial passage. The sleeve, in conjunction with the feeder structure forms a trap, isolating the helical elements from ground, yet providing conductive paths around its rim interconnecting the helical elements. This antenna is intended primarily as an omnidirectional antenna for receiving circularly polarised signals from sources which may be directly above the antenna, i.e. on its axis, or at smaller angles of elevation down to a few degrees above a plane perpendicular to the axis. It follows that this antenna is particularly suitable for receiving signals from global positioning system (GPS) satellites. Since the antenna is also capable of receiving vertically or horizontally polarised signals, it may be used in other radiocommunication apparatus such as handheld cordless or mobile telephones.

A dielectric-loaded antenna which is particularly suited to portable telephone use is a bifilar helical loop antenna in which two diametrically opposed half turn helical elements form, in conjunction with a conductive sleeve as described above, a twisted loop yielding a radiation pattern which is omnidirectional with the exception of two opposing nulls centred on an axis perpendicular to the plane formed by the four ends of the two helical elements. This antenna is disclosed in our co-pending U.S. patent application Ser. No. 08/664,104 the contents of which form part of the disclosure of the present application by reference. When this loop antenna is appropriately mounted in a mobile telephone handset, the presence of the nulls reduces the level of radiation directed into the user's head during signal transmission. While the antenna gain is superior to many prior mobile telephone handset antennas, it is significantly less than the maximum value above and below a central resonant frequency. It is an object of this invention to provide an antenna of relatively wide bandwidth or capable of operating in two frequency bands.

SUMMARY OF THE INVENTION

According to a first aspect of this invention, there is provided a dielectric-loaded loop antenna for operation at frequencies above 200 MHz comprising an elongate dielectric core formed of a solid material having a relative dielectric constant greater than 5 and, on or adjacent the surface of the core, a three-dimensional antenna element structure including at least a pair of laterally opposed elongate antenna elements which extend between longitudinally spaced-apart positions on the core, and linking conductors extending around the core to interconnect the said elements of the pair, the elongate elements having respective first ends coupled to a feed connection and second ends coupled to the linking conductors, wherein the said elongate elements and the linking conductors together form at least two looped conductive paths each extending from the feed connection to a location spaced lengthwise of the core from the feed connection, then around the core, and back to the feed connection, the electrical length of one of the two paths being greater than that of the other path at an operating frequency of the antenna. Since the looped conductive paths have different electrical lengths, their resonant frequencies are different and can be selected so as to coincide, for example, with the centre frequencies of the transmit and receive bands of a mobile telephone system.

The linking conductors may be formed by a quarter wave balun on the outer surface of the core adjacent the end opposite to the feed connection, the latter being provided by a feeder structure extending longitudinally through the core. In one preferred embodiment, the linking conductors are formed by mutually isolated parts of a balun sleeve so that each of the two looped conductive paths includes the rim of a respective sleeve part. The sleeve parts are isolated from each other by longitudinally extending slits in the conductive material forming the sleeve, the electrical length of each slit from a respective short-circuited end to the relevant sleeve rim being at least approximately equal to a quarter wavelength at the operating frequency so that isolation between the two sleeve parts is provided at their junctions with the elongate antenna elements.

Alternatively, each linking conductor may be formed by a conductive strip extending around a respective side of the core from one elongate antenna element to another. In another alternative, one linking conductor may be formed in this way, and the other may be formed by the rim of a quarter wave balun sleeve, with or without the slits described above. The advantage of incorporating a balun sleeve is that the antenna may then operate in a balanced mode from a single-ended feed coupled to the feeder structure.

Advantageously, the antenna element structure has a single pair of laterally opposed elongate antenna elements each of which is forked so as to have a divided portion which extends from a location between the first and second ends of the element as far as a respective one of the linking conductors. The difference in electrical length between the two looped conductive paths may be achieved by forming one or both of the divided portions as branches of different electrical lengths. Each branch may then be connected to respective linking conductors extending around opposite sides of the core which, at least in the region of the elongate elements are isolated from each other. It will be appreciated that the difference in path lengths may be achieved not only by making the branches of different lengths, but by forming the linking conductors differently on opposite sides of the core.

Particularly satisfactory operation can be achieved by arranging for the electrical length of each branch to be approximately 90° (or $(2n+1)\lambda/4$ where n=0, 1, 2 . . . ) at the resonant frequency of its respective conductive path, $\lambda$ being the corresponding wavelength. The linking conductors represent a location of low impedance at the operating frequency, and each 90° length acts as a current-to-voltage transformer so that the impedance at the fork of each forked element is relatively high. Accordingly, at the resonant frequency of one of the conductive paths, excitation occurs in that path simultaneously with isolation from the other path or paths. It follows that two or more distinct resonances can be achieved at different frequencies due to the fact that each branch loads the conductive path of the other only minimally when the other is at resonance. In effect, two or more mutually isolated low impedance paths are formed around the core.

In the preferred antenna in accordance with the invention, the advantageous low impedance connection point for the antenna elements at their junction with the linking conductor or conductors is provided by annular linking conductors in the form of a cylindrical split conductive sleeve which operates in conjunction with a feeder structure extending longitudinally through the core to form an isolating trap which causes currents circulating around the looped conductive paths to be confined to the rim of the sleeve. By connecting the proximal end of the sleeve to the feeder structure and arranging for the longitudinal electrical length of the sleeve to be at least approximately n×90° within the operating frequency band of the antenna (where n is an odd number), the sleeve provides a virtual ground for the elongate antenna elements. The sleeve is split in the sense that longitudinally extending slits are formed as breaks in the conductive material of the sleeve. Thus, in the case of each elongate antenna element having branches as described above which are connected to the rim of the sleeve, there are two slits each of which extends from the space between the branches of a respective one of the elongate antenna elements to a respective short circuited end thereby forming two part-cylindrical sleeve parts. Since the slits each have an electrical length of about a quarter wavelength ($\lambda/4$) in the operating frequency band, the zero impedance of the short-circuited end is transformed to a high impedance between the sleeve parts at their junctions with the branches of the elongate antenna elements.

To accommodate the preferred $\lambda/4$ electrical length for each slit, each may be L-shaped, having a first part which runs longitudinally and a second part adjacent the short circuited end which runs perpendicularly to the longitudinal part. By arranging for one of the second end parts to be directed in one direction around the core and the other second part to be directed in the opposite direction around the core, the electrical length of one of the sleeve parts can be increased with respect to the other (by virtue of a pinching of the longitudinal conductive path). The significance of this becomes apparent when the rim of one sleeve part is at a different longitudinal location from the rim of the other sleeve part, in that if the pinching is arranged in the shorter of the sleeve parts, its electrical length may be increased so that the frequency at which the balun action occurs most effectively is brought nearer to the resonant frequency of the longer of the two looped conductive paths. Thus, with the ends of the elongate antenna elements lying generally in a common plane, the rim of the complete sleeve is effectively stepped insofar as the connection it provides around one side of the antenna is at a different longitudinal position on the core from the connection it provides around the opposite side. This means that if each forked antenna element has two branches, one shorter than the other, the shorter ones may be connected to that portion of the sleeve rim which is nearer the distal end of the core while the other, longer branches are connected to that part of the rim which is further from the distal end thereby creating conductive loops at different lengths and with different resonant frequencies. The branched portions of each element advantageously run parallel and close to each other, terminating on the sleeve rim at the bottom and top of the respective step in the rim, i.e. at the high impedance ends of the slit.

Extension of the antenna bandwidth and a reduction in physical length may be achieved, in the case of a cylindrical rod-shaped core by forming each elongate antenna element as a half-turn helix. Preferably, the helix is forked at a position approximately midway between the end of the rod and the linking conductor.

According to another aspect of the invention, a dielectric-loaded loop antenna for operation at frequencies above 500 MHz comprises an elongate cylindrical core having a relative dielectric constant greater than 5, and an antenna element structure on the core outer surface comprising a pair of diametrically opposed elongate antenna elements and annularly arranged linking conductors. The elongate elements extend from a feed connection at one end of the core to the linking conductors, with the ends of the elongate elements preferably lying substantially in a common plane containing the core axis insofar as the angular differences between the lines formed by radii joining the ends of the elongate elements to the core axis are no more than 20°. To achieve resonances at spaced apart frequencies, the elongate elements are each bifurcated to define two looped conductive paths of different electrical lengths, each coupled to the feed connection.

The invention also includes, according to yet a further aspect, a handheld radio communication unit having a radio transceiver, an integral earphone for directing sound energy from an inner face of the unit which, in use, is placed against the user's ear, and an antenna as described above. The antenna is mounted such that the common plane lies generally parallel to the inner face of the unit so that a null in the radiation pattern of the antenna exists in the direction of the user's head.

BRIEF DESCRIPTION OF THE DRAWINGS

The invention will be described below by way of example with reference to the drawings in which.

DETAILED DESCRIPTION OF THE PREFERRED EMBODIMENTS

Figure 1:
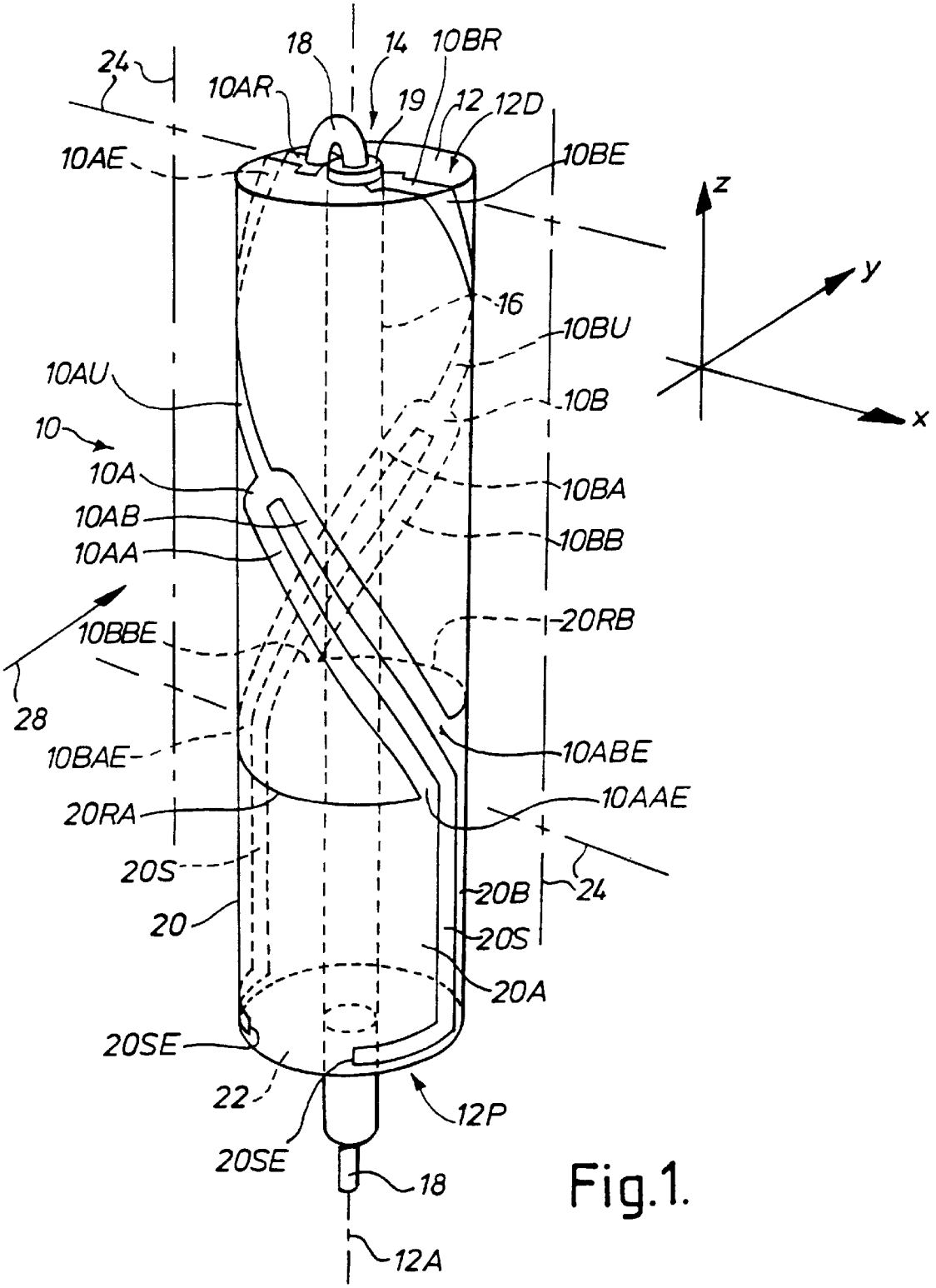
FIG. 1 is a perspective view of an antenna in accordance with the invention.

Referring to FIG. 1, a preferred antenna 10 in accordance with the invention has an antenna element structure with two longitudinally extending metallic antenna elements 10A, 10B on the cylindrical outer surface of a ceramic core 12.

The core 12 has an axial passage 14 with an inner metallic lining 16, and the passage houses an axial inner feeder conductor 18 surrounded by a dielectric insulating sheath 19. The inner conductor 18 and the lining 16 in this case form a feeder structure for coupling a feed line to the antenna elements 10A, 10B at a feed position on the distal end face 12D of the core. The antenna element structure also includes corresponding radial antenna elements 10AR, 10BR formed as metallic conductors on the distal end face 12D connecting diametrically opposed ends 10AE, 10BE of the respective longitudinally extending elements 10A, 10B to the feeder structure.

In this embodiment, the longitudinally extending elements 10A, 10B are of equal average length, each being in the form of a helix executing a half turn around the axis 12A of the core 12, each helix laterally opposing the other and being longitudinally co-extensive. It is also possible for each helix to execute multiple half turns, e.g. a full turn or 1½ turns. The antenna elements 10A, 10B are connected respectively to the inner conductor 18 and outer lining 16 of the feeder structure by their respective radial elements 10AR, 10BR.

Each of the longitudinally extending elements 10A, 10B has a proximal divided portion formed by respective pairs of parallel substantially quarter wave branches 10AA, 10AB and 10BA, 10BB. These branches extend in generally the same direction as the undivided portion 10AU, 10BU, of each element 10A, 10B, the junction between undivided and divided portions being, in this embodiment, approximately midway between the distal and proximal ends of elements 10A, 10B. To form complete conductive loops, each antenna element branch 10AA, 10AB, 10BA, 10BB is connected to the rim (20RA, 20RB) of a common virtual ground conductor 20 in the form of a conductive sleeve surrounding a proximal end portion of the core 12. This sleeve 20 is in turn connected to the lining 16 of the axial passage 14 by plating 22 on the proximal end face 12P of the core 12. Thus each conductive loop formed by the helical elements 10A, 10B (including the respective branches), the radial elements 10AR, 10BR, and the rim of the respective portion 20RA, 20RB of the sleeve 20 is fed at the distal end of the core by a feeder structure which extends through the core from the proximal end, and lies between the antenna elements 10A, 10B. The antenna consequently has an end-fed bifilar helical structure.

Over at least its upper or distal portion, the sleeve 20 is split into two opposed parts 20A, 20B each subtending an angle approaching 180° at the core axis 12A, and separated from each other by longitudinal slits 20S which are breaks in the conductive material of the sleeve 20 extending from the spaces between the proximal ends 10AAE, 10ABE, 10BAE, 10BBE of the antenna element branches to short-circuited ends 20SE.

In this embodiment each of the slits 20S has a longitudinal portion parallel to the core axis and a tail portion which extends around the core, the two portions forming an "L". The lower tail portions are directed in opposite directions towards each other so as to pinch the width of the shorter (20A) of the two sleeve parts 20A, 20B.

At any given transverse cross-section through the antenna 10, the antenna elements 10A, 10B are substantially diametrically opposed, and the proximal ends 10AAE, 10ABE, 10BAE, 10BBE of the antenna element branches are also substantially diametrically opposed where they meet the rim of sleeve 20, as are the slits 20S.

It will be noted that the ends 10AE, 10BE, 10AAE, 10ABE, 10BAE, 10BBE of the antenna elements 10A, 10B all lie substantially in a common plane containing the axis 12A of the core 12. The effect of this is explained hereinafter. This common plane is indicated by the chain lines 24 in FIG. 1. The feed connection to the antenna element structure and the feeder structure also lie in the common plane 24.

In this preferred antenna as shown in FIG. 1, the conductive sleeve 20 covers a proximal portion of the antenna core 12, thereby surrounding the feeder structure 16, 18, the material of the core 12 filling the whole of the space between the sleeve 20 and the metallic lining 16 of the axial passage 14. The sleeve 20 forms a split cylinder connected to the lining 16 by the plating 22 of the proximal end face 12P of the core 12, the combination of the sleeve 20 and plating 22 forming a balun so that signals in the transmission line formed by the feeder structure 16, 18 are converted between an unbalanced state at the proximal end of the antenna and a balanced state at an axial position approximately in the plane of the upper edge 20RA, 20RB of the sleeve 20. To achieve this effect, the axial lengths of the sleeve parts 20A, 20B are such that in the presence of an underlying core material of relatively high dielectric constant, the balun has an electrical length of about $\lambda/4$ or 90° in the operating frequency band of the antenna. Since the core material of the antenna has a foreshortening effect, and the annular space surrounding the inner conductor 18 is filled with an insulating dielectric material 19 having a relatively small dielectric constant, the feeder structure distally of the sleeve 20 has a short electric length. As a result, signals at the distal end of the feeder structure 16, 18 are at least approximately balanced.

A further effect of the sleeve 20 is that for signals in the region of the operating frequency of the antenna, the rim parts 20RA, 20RB of the sleeve 20 are effectively isolated from the ground represented by the outer conductor 16 of the feeder structure. This means that currents circulating between the antenna elements 10A, 10B are confined substantially to the rim parts. The sleeve 20 thus acts as an isolating trap to reduce the phase-distorting influence of unbalanced currents in the antenna.

The preferred material for the core 12 of the antenna is a zirconium-titanate-based material. This material has a relative dielectric constant of 36 and is noted also for its dimensional and electrical stability with varying temperature. Dielectric loss is negligible. The core may be produced by extrusion or pressing.

The antenna elements 10A, 10B, 10AR, 10BR are metallic conductor tracks formed on or adjacent the outer cylindrical and distal end surfaces of the core 12, each track being of a width at least as great as its thickness over its operative length. The tracks may be formed by initially plating the surfaces of the core 12 with a metallic layer and then selectively removing the layer to expose the core according to the required pattern. Alternatively, the metallic material may be applied by selective deposition or by printing techniques. In all cases, the formation of the tracks as an integral elements at the outside of a dimensionally stable core leads to an antenna having dimensionally stable antenna elements.

It will be understood from the above that the longitudinally extending antenna elements 10A, 10B, together with the rim portions 20RA, 20RB of the sleeve parts 20A, 20B, form two looped conductive paths in the operating frequency range of the antenna, each looped path being isolated from ground. Thus, a first looped conductive path begins at the feed connection on the distal face 12D of the core and extends via radial conductor 10AR, the upper portion of element 10A, one of the branches 10AA of the lower portion of element 10A, a first semicircular portion 20RA of the rim of sleeve 20 extending around one side of the core 12, one of the branches 10BA of element 10B, the distal portion of element 10B and, finally, the radial conductor 10BR back to the feeder. The other conductive path also forms a loop beginning at the feeder. In this case, the path follows element 10AR, the distal portion of element 10A, the other branch 10AB of element 10A, the other portion 20RB of the rim of sleeve 20, this time extending around the opposite side of the core 12 from rim portion 20RA, then via the other branch 10BB of antenna element 10B, the distal portion of element 10B and, finally, back to the feeder via radial element 10BR.

These two conductive paths are of different physical and electrical lengths as a result of the branches 10AA, 10BA of the first conductive path being longer than those 10AB, 10BB of the second conductive path, and by virtue of the rim portion 20RA being further from the feed connection at the distal end 12D of the core than the other rim portion 20RB. This difference in height between the two rim portions 20RA and 20RB results in the rim having a stepped profile with the antenna element branches of each element 10A, 10B being joined to the sleeve 20 on opposite sides of the rim steps, as shown in FIG. 1. As a result of the differing lengths of the looped conductive paths, they have different resonant frequencies.

Figure 2:
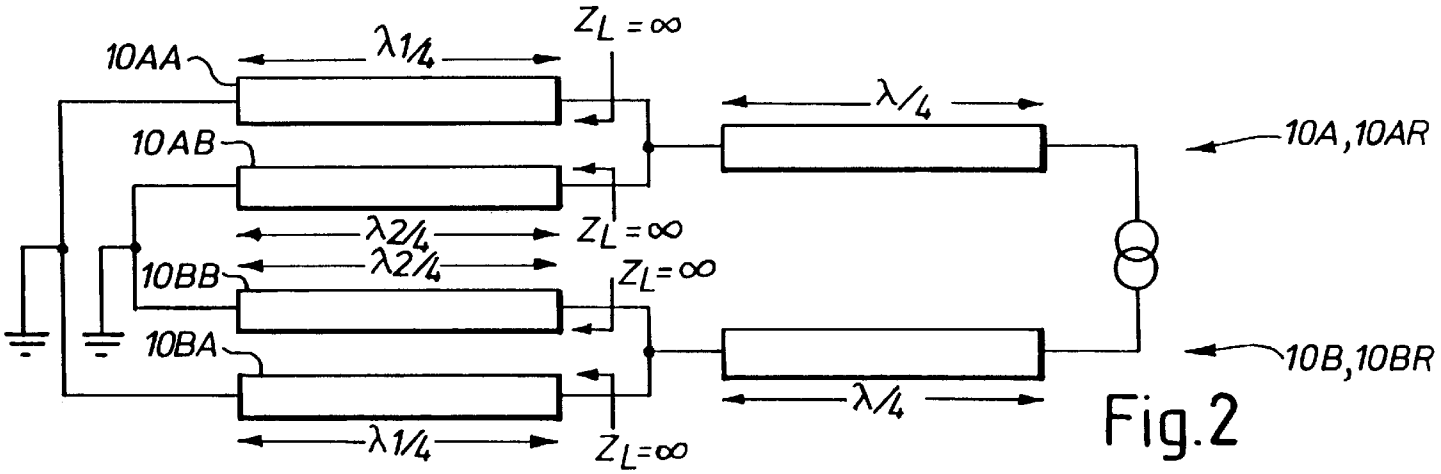
FIG. 2 is an equivalent circuit diagram of part of the antenna of FIG. 1.

An equivalent circuit diagram representing the antenna element structure of the antenna of FIG. 1 is shown in FIG. 2. The undivided distal portion of each antenna element 10A, 10B, together with the respective radial connections 10AR, 10BR may be represented by a transmission line section of an electrical length which is at least approximately equal to $\lambda/4$ or, more generally, $(2n+1)\lambda/4$ where $\lambda$ is the centre wavelength of the antenna operating band and n=0, 1, 2, 3 . . . The branches 10AA, 10AB, 10BA, 10BB are represented by similar transmission line sections, i.e. as two pairs of parallel-connected sections, all connected in series between the distal portions of the antenna elements 10A, 10B and the virtual ground represented by the rim portions 20RA, 20RB of the sleeve 20. The branch sections have electrical lengths $\lambda_1/4$ or $\lambda_2/4$ as shown, depending whether they are part of the longer or the shorter looped conductive path, the longer having a resonant frequency corresponding to a wavelength $\lambda_1$ and the shorter having a resonant frequency corresponding to a wavelength $\lambda_2$.

Since the isolating effect of the sleeve 20 confines currents mainly to the rim portions 20RA, 20RB when the antenna is resonant in a loop mode, they represent locations of current maxima. For signals having a wavelength in the region of $\lambda_1$ and $\lambda_2$, the quarter wavelength branches 10AA–10BB act as current-to-voltage transformers so that at the point where each antenna element is split there is a voltage maximum and the impedance looking into each branch tends to infinity, as shown in FIG. 2. Consequently, when one conductive loop is in resonance, the impedance looking into the branches of the other loop is high (providing $\lambda_1$ and $\lambda_2$ are of the same order). This means that the resonance of one loop is not significantly affected by the conductors of the other loop. There is, therefore, a degree of isolation between the two resonant modes embodied in two distinct paths.

The individual antenna elements 10A, 10B, being each split into two parallel conductors passing from the balun connection point (i.e. the sleeve rim) to the points of voltage maxima at intermediate locations along the elements, isolate the two resonant paths (the conductive loops) from each other. This arrangement, as shown in FIG. 2, may be viewed as either a transforming or coupled line system.

The stepped sleeve rim 20RA, 20RB not only creates two differing loop path-lengths around opposite sides of the core such that two resonant frequencies are possible, but also it splits the choke balun represented by the sleeve 20 into two parallel resonant lengths.

It should be noted that each longitudinal slit 20S in the sleeve 20 is arranged to have an electrical length in the region of a quarter wavelength at the centre frequency of the required operating frequency range, and it is for this reason that they are L-shaped in the embodiment of FIG. 1. It will be appreciated that sufficient length can be obtained from other configurations, for example by causing the slits to have a meandered path or by allowing them to extend around the proximal edge of the antenna into the plating 22 on the proximal end face 12P of the core 12. These quarter wave slits 20S have the effect of isolating the upper regions of the two sleeve parts 20A, 20B from each other so as to confine the currents in the longer of the two conductive loops to the rim portion 20RA, and those in the shorter loop to the rim portion 20RB. Isolation is achieved by transformation of the zero impedance of the short circuited ends 20SE to a high impedance between the sleeve parts 20A, 20B at the level of the two rim parts 20RA, 20RB.

Arranging the tail portions of the slits 20S to be directed towards each other as shown in FIG. 1 has the effect of introducing a restriction in the current path between the rim portion 20RA of the shorter (20A) of the two sleeve parts 20A, 20B and the connection of the sleeve to the feeder structure 16 at the proximal end of the core. This restriction increases the longitudinal impedance of sleeve part 20A, in effect by adding an inductance, thereby tending to reduce the frequency at which the balun effect due to that sleeve part 20A is most pronounced. Indeed, this frequency can be made to coincide with the resonant frequency of the looped conductive path which includes the rim of this sleeve part 20A, in this case the longer of the looped conductive paths.

Figure 3C:
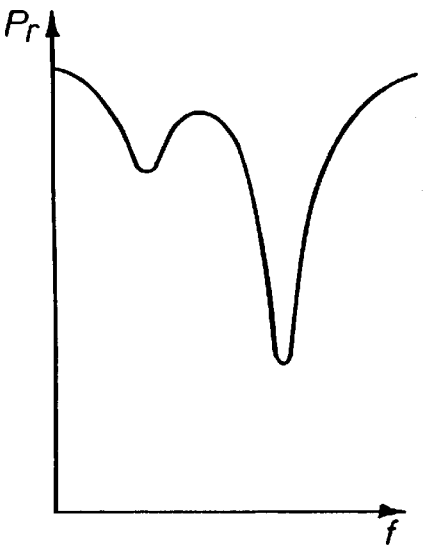
FIGS. 3A, 3B and 3C are graphs showing reflected power as a function of frequency.
Figure 3B:
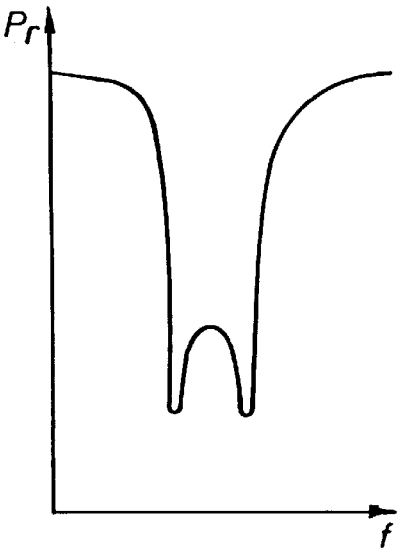
Figure 3A:
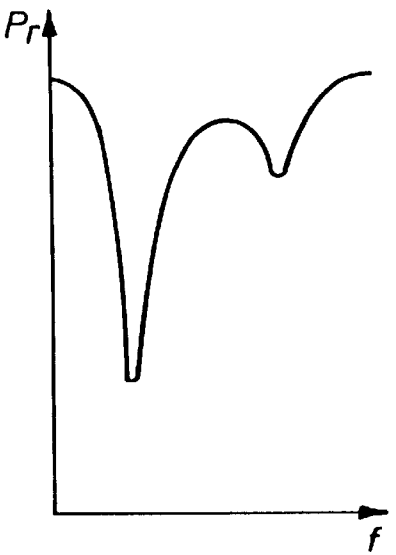

The length of the slits has an effect on the ability of the antenna to operate efficiently at spaced frequencies. Referring to FIGS. 3A, 3B, and 3C, if the slit is too short to promote effective isolation between the upper regions of the two sleeve parts 20A, 20B, a comparatively weak secondary peak is formed at the higher of two resonant frequencies, as shown in FIG. 3A. At an optimum slit length, strong isolation is obtained and constructive combination of the two resonances due to the two conductive loops occurs, as shown in FIG. 3B, from which it will be seen that strong resonances occur at two spaced apart frequencies which, however, are closer together than the two frequencies of resonance shown in FIG. 3A. If the length of the slits is increased further, isolation is less effective and the antenna has a primary resonance at a higher frequency and a weaker, secondary resonance at a lower frequency; the opposite situation to that of FIG. 3A. Depending on the tolerance to which the antenna is manufactured, individual adjustment of each antenna can be provided by initially forming the slits with a comparatively short overall length, and removing the conductive material of the sleeve 20 at the slit ends 20SE according to test results. This can be done by, for instance, grinding, or by laser ablation.

Arranging for the ends 10AE, 10BE, 10AAE, 10ABE, 10BAE, and 10BBE of the antenna elements 10A, 10B to lie all substantially in the common plane 24 (FIG. 1) is the preferred basis for configuring the antenna element structure such that the integral of currents induced in elemental segments of this structure by a wave incident on the antenna from a direction 28 normal to the plane 24 and having a planar wavefront sums to zero at the feed position, i.e. where the feeder structure 16, 18 is connected to the antenna element structure. In practice, the two elements 10A, 10B are equally disposed and equally weighted on either side of the plane 24, yielding vectoral symmetry about the plane.

Figure 4:
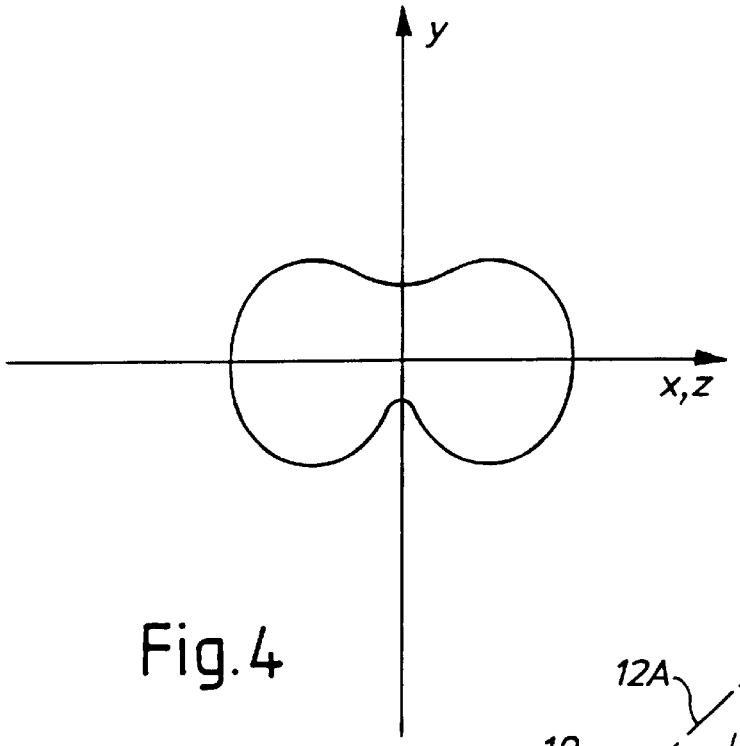
FIG. 4 is a diagram illustrating the radiation pattern of the antenna of FIG. 1.

The antenna element structure with half-turn helical elements 10A, 10B performs in a manner similar to a simple planar loop, having a null in its radiation pattern in a direction transverse to the axis 12A and perpendicular to the plane 24. The radiation pattern is, therefore, approximately of a figure-of-eight form in both the vertical and horizontal planes transverse to the axis 12A, as shown by FIG. 4. Orientation of the radiation pattern with respect to the perspective view of FIG. 1 is shown by the axis system comprising axes x, y, z shown in both FIG. 1 and FIG. 4. The radiation pattern has two nulls or notches, one on each side of the antenna, and each centred on the line 28 shown in FIG. 1.

The notch in the direction y tends to be somewhat shallower than that in the opposite direction, as shown in FIG. 4, due to the masking of the current-carrying sleeve rim portion 20RA by the longer sleeve portion 20B when the antenna is viewed from the right hand side, as seen in FIG. 1.

Figure 5:
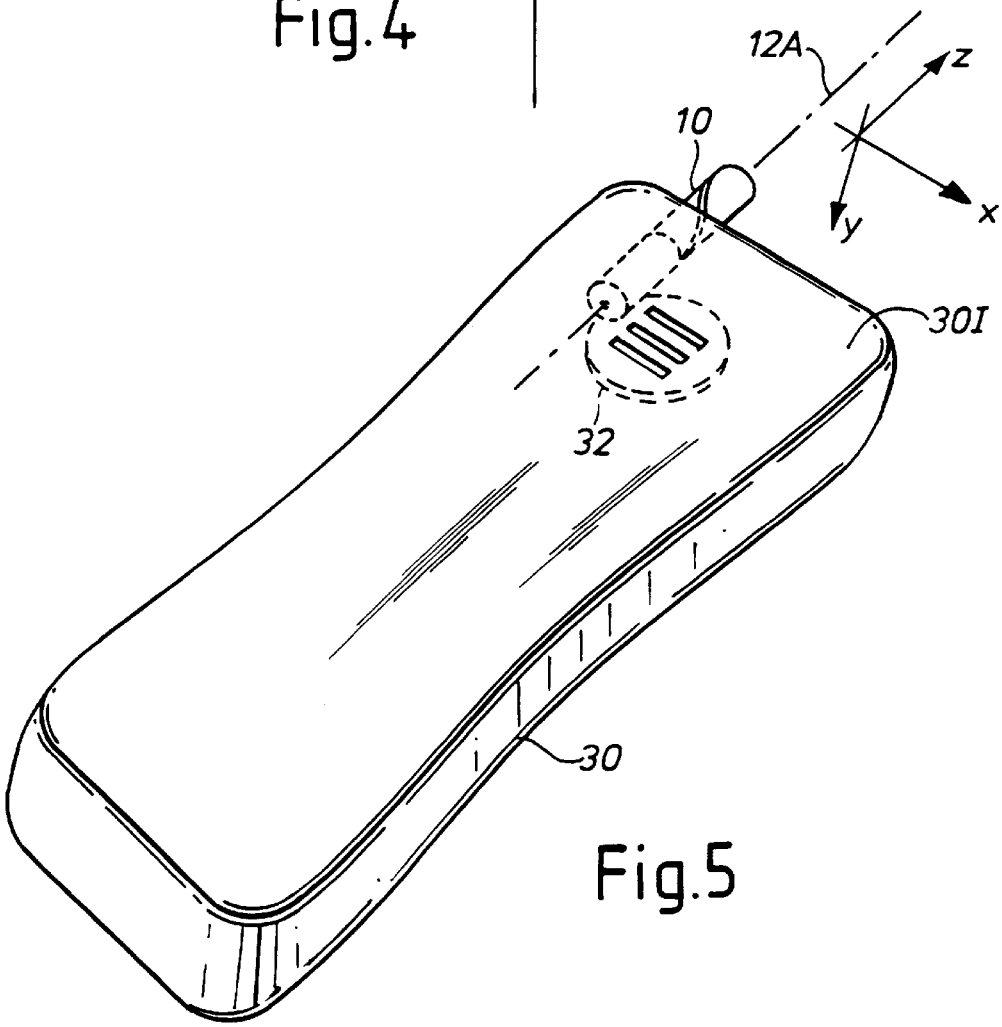
FIG. 5 is a perspective view of a telephone handset, incorporating an antenna in accordance with the invention.

The antenna has particular application at frequencies between 200 MHz and 5 GHz. The radiation pattern is such that the antenna lends itself especially to use in a handheld communication unit such as a cellular or cordless telephone handset, as shown in FIG. 5. To orient one of the nulls of the radiation pattern in the direction of the user's head, the antenna is mounted such that its central axis 12A (see FIG. 5) and the plane 24 (see FIG. 1) are parallel to the inner face 30I of the handset 30, and specifically the inner face 30I in the region of the earphone 32. The axis 12A also runs longitudinally in the handset 30, as shown. The more proximal rim portion 20RB of sleeve 20 (FIG. 1) is on the same side of the antenna core as the inner face 30I of the handset. Again, the relative orientations of the antenna, its radiation pattern, and the handset 30 are evident by comparing the axis system x, y, z as it is shown in FIG. 5 with the representations of the axis system in FIGS. 1 and 2.

With a core material having a substantially higher relative dielectric constant than that of air, e.g. $\in_r$=36, an antenna as described above for the DECT band in the region of 1880 MHz to 1900 MHz typically has a core diameter of about 5 mm and the longitudinally extending elements 10A, 10B have an average longitudinal extent (i.e. parallel to the central axis 12A) of about 16.25 mm. The width of the elements 10A, 10B and their branches is about 0.3 mm. At 1890 MHz the length of the balun sleeve 20 is typically in the region of 5.6 mm or less. Expressed in terms of the operating wavelength $\lambda$ in air, these dimensions are, at least approximately, for the longitudinal (axial) extent of the elements 10A, 10B: 0.102$\lambda$, for the core diameter: 0.0315$\lambda$, for the balun sleeve: 0.035$\lambda$ or less, and for the track width: 0.00189$\lambda$. Precise dimensions of the antenna elements 10A, 10B can be determined in the design stage by undertaking eigenvalue delay measurements and iteratively correcting for errors on a trial and error basis.

Adjustments in the dimensions of the conductive elements during manufacture of the antenna may be performed in the manner described in our above-mentioned UK Patent Application No. 2292638A with reference to FIGS. 3 to 6 thereof. The whole of the subject matter of this prior application is incorporated in the present application by reference.

The small size of the antenna suits its application in handheld personal communication devices such as mobile telephone handsets. The conductive balun sleeve 20 and/or the conductive layer 22 on the proximal end face 12P of the core 12 allow the antenna to be directly mounted on a printed circuit board or other ground structure in a particularly secure manner. Typically, if the antenna is to be end-mounted, the proximal end face 12P can be soldered to a ground plane on the upper face of a printed circuit board with the inner feed conductor 18 passing directly through a plated hole in the board for soldering to a conductor track on the lower surface. Alternatively, sleeve 20 may be clamped or soldered to a printed circuit board ground plane extending parallel to the axis 12A, with the distal part of the antenna, bearing antenna elements 10A, 10B, extending beyond an edge of the ground plane. It is possible to mount the antenna 10 either wholly within the handset unit, or partially projecting as shown in FIG. 5.

Alternative antennas in accordance with the invention are illustrated in FIGS. 6 to 9.

Figure 6:
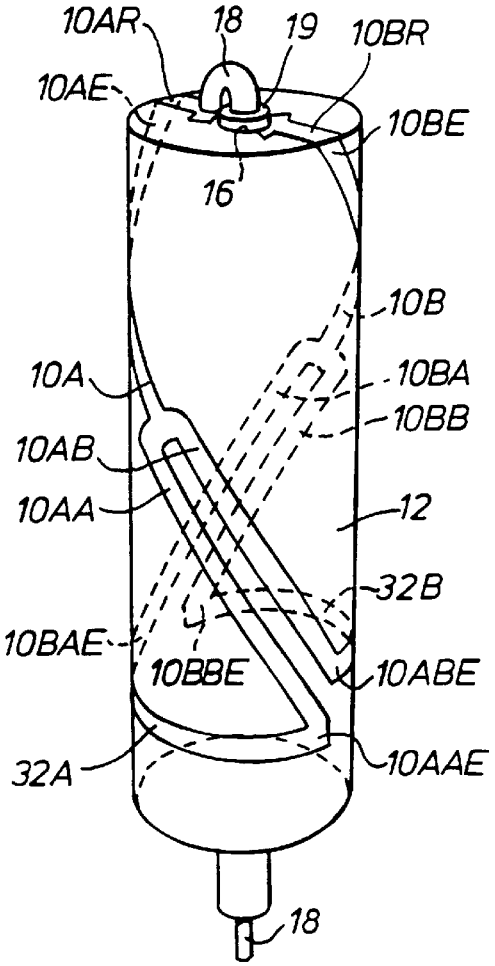
FIG. 6 is a perspective view of a first alternative antenna in accordance with the invention.

Referring firstly to FIG. 6, a comparatively simple antenna dispenses with the sleeve balun of FIG. 1, the linking conductors formed by the rim portions of the sleeve in FIG. 1 being replaced by part-annular elongate strip elements 32A, 32B, one of which is connected to the proximal ends 10AAE, 10BBE of the longer antenna element branches 10AA, 10BB, the other being connected to the proximal ends 10ABE, 10BAE of the shorter branches 10AB, 10BA to form conductive loops of different lengths. As in the embodiment of FIG. 1, the ends of the antenna elements lie in a common plane, yielding a generally toroidal radiation pattern with nulls perpendicular to the plane. This antenna, lacking a balun, operates best when coupled to a balanced source or balanced load.

Figure 7:
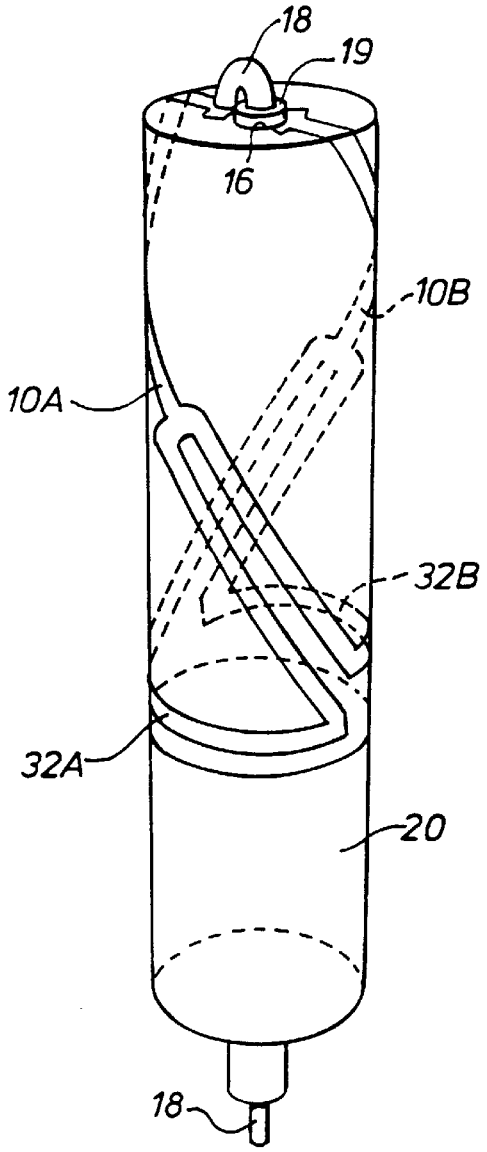
FIG. 7 is a perspective view of a second alternative antenna in accordance with the invention.

A second alternative antenna, as shown in FIG. 7, has the same antenna element structure as the antenna of FIG. 6, including as it does semicircular elongate linking conductors 32A, 32B extending around the core 12 at different longitudinal positions, but adds a conductive sleeve balun 20 encircling a proximal portion of the core 12 and connected to the outer conductor of the feeder structure as in the antenna of FIG. 1. This allows conversion between balanced and single-ended lines, but with isolation between the linking conductors 32A, 32B being provided solely by their separation from each other and from the sleeve 20.

Figure 8:
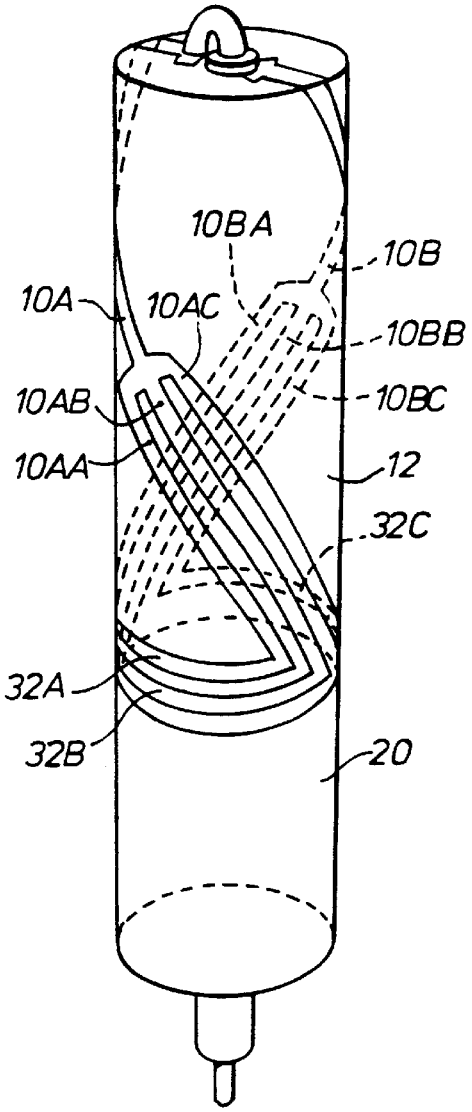
FIG. 8 is a perspective view of a third alternative antenna in accordance with the invention.

Referring to FIG. 8, the third alternative antenna is similarly constructed to the second alternative antenna shown in FIG. 7, except that an additional conductive loop is provided by virtue of each elongate helical antenna element 10A, 10B having a divided portion with three branches 10AA, 10AB, 10AC, 10BA, 10BB, and 10BC. As before, each pair of branches is proximally connected together by a respective linking conductor extending around the core 12, but since there are three pairs of branches there are now three respective linking conductors 32A, 32B, 32C. These are located at different longitudinal positions so that the three conductive loops formed by the antenna elements and the linking conductors are each of a different electrical length, thereby defining three resonant frequencies. As in the embodiment of FIG. 7, the conductive balun sleeve 20 is a continuous cylinder, the proximal end of which is connected to the outer conductor of the feeder structure.

The embodiment of FIG. 8 indicates that, depending on the area of the core and the width of the antenna elements, two or more conductive loops can be provided to achieve a required antenna bandwidth. The antenna element ends still lie approximately in a common plane.

Figure 9:
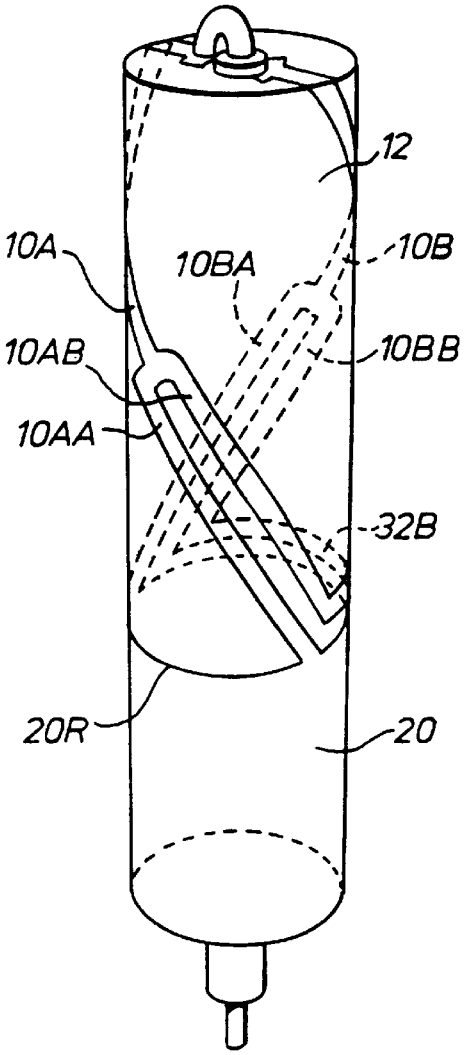
FIG. 9 is a perspective view of a fourth alternative antenna in accordance with the invention.

Referring to FIG. 9, in a fourth alternative construction, the continuous conductive balun sleeve 20 is used as the linking conductor for one of the two branches of a dual conductive loop antenna. Thus, the pair of longer antenna element branches 10AA, 10BB is connected to the annular rim 20R of the sleeve 20 at approximately diametrically opposed positions. The pair of shorter branches, 10AB, 10BB has an elongate linking conductor 32B as in the embodiments of FIGS. 6 to 8, isolated from the sleeve 20. This combines the advantages of isolation between the linking conductors, the presence of a balun, and an overall length which is less than the second alternative embodiment described above with reference to FIG. 7.

What is claimed is:

1. A dielectric-loaded loop antenna for operation at frequencies above 200 MHz comprising an elongate dielectric core formed of a solid material having a relative dielectric constant greater than 5 and, on or adjacent the surface of the core, a three-dimensional antenna element structure including at least a pair of laterally opposed elongate antenna elements which extend between longitudinally spaced-apart positions on the core, and linking conductors extending around the core to interconnect the elongate elements of the pair, the elongate elements of said pair having respective first ends coupled to a feed connection and linking conductors extending around the core to interconnect the elongate elements of the pair, the elongate elements of said pair having respective first ends coupled to a feed connection and second ends coupled to the linking conductors, wherein for each pair of laterally opposed elongate antenna elements, said elongate elements and said linking conductors together form at least two looped conductive paths each extending from the feed connection to the location spaced lengthwise of the core from the feed connection, then around the core, and back to the feed connection, the electrical length of one of the two paths being greater than that of the other path at an operating frequency of the antenna.

2. An antenna according to claim 1, having a single pair of laterally opposed elongate antenna elements, each of said elements being forked so as to have a divided portion which extends from a location between said first and second ends to said second end.

3. An antenna according to claim 2, wherein the divided portion of at least one of the antenna elements comprises branches of different electrical lengths.

4. An antenna according to claim 3, wherein the electrical length of each branch is in the region of $\lambda/4$ at the resonant frequency of the respective looped conductive path.

5. An antenna according to claim 2, wherein, for each looped conductive path at its respective resonant frequency, the total electrical length formed by the divided portions and the respective linking conductor is in the region of 180°.

6. An antenna according to claim 2, wherein each element of said pair is forked at a location corresponding to a voltage maximum at an operating frequency of the antenna.

7. An antenna according to claim 1, having a plurality of part-annular linking conductors extending around the core, each said elongate antenna element extending between the feed connection and the linking conductors.

8. An antenna according to claim 7, wherein said first and second ends of said elongate antenna elements lie generally in a common plane, and wherein said linking conductors define a first linking path extending around one side of the core substantially at a first longitudinal location and a second linking path extending around the other side of the core substantially at a different longitudinal location.

9. An antenna according to claim 1, including a conductive sleeve, and a feeder structure extending longitudinally through the core from a distal end of the core to a proximal end thereof, the feeder structure providing the feed connection at the core distal end and being coupled at the core proximal end to the conductive sleeve to form a ground connection for the sleeve.

10. An antenna according to claim 9, wherein the electrical length of the sleeve is at least approximately equal to $\lambda/4$ at an operating frequency of the antenna wherein n is an odd number integer.

11. An antenna according to claim 9, wherein the elongate antenna elements are coupled to a distal rim of the sleeve, which rim constitutes at least one of said linking conductors.

12. An antenna according to claim 2, including a conductive sleeve, and a feeder structure extending longitudinally through the core from a distal end of the core to a proximal end thereof, the feeder structure providing the feed connection at the core distal end and being coupled at the core proximal end to the conductive sleeve to form a ground connection for the sleeve, wherein the elongate antenna elements are coupled to the sleeve, and wherein each of the divided portions of the antenna elements has branches one of which is connected to the distal rim of a first part of the sleeve to form a linking path around one side of the core and another of which is connected to the distal rim of a second part of the sleeve to form a linking path around the other side of the core, the first and second parts of the sleeve being separated from one another over at least part of their longitudinal extent by a pair of longitudinally extending slits in the conductive material of the sleeve.

13. An antenna according to claim 12, wherein each slit has a short-circuit end and thereby has an electrical length which is at least approximately equal to one quarter of a wavelength at the said operating frequency.

14. An antenna according to claim 13, wherein each slit is generally L-shaped.

15. An antenna according to claim 14, wherein the short-circuited end portions of the slits are directed in opposite directions around the core.

16. An antenna according to claim 12, wherein the distal rim of the first part of the sleeve extends around the core at one longitudinal location, and the distal rim of the second part of the sleeve extends around the other side of the core at a different longitudinal location.

17. An antenna according to claim 15, wherein the distal rim of the first part of the sleeve extends around the core at one longitudinal location, and the distal rim of the second part of the sleeve extends around the other side of the core at a different longitudinal location and wherein the short-circuited end portions of the slits are directed towards each other so as to cause a narrowing of the longitudinal conductive path formed by the said sleeve part which has its distal rim nearer the proximal end of the core.

18. An antenna according to claim 2, wherein the core is substantially cylindrical and each said elongate antenna element is helical, executes p half turns around the core, where p is an integer, and is forked such that the respective divided portion has two parallel helical branches following substantially the same helical path as the undivided portion of the element.

19. An antenna according to claim 18, further comprising a coaxial feeder structure passing through the core on its central axis from a proximal end to a distal end of the core, wherein the linking conductors are formed by a longitudinally split conductive sleeve connected to the outer conductor of the feeder structure at the core proximal end and having a distal rim connected to branches of the elongate antenna elements, the feeder structure providing the said feed connection at the core distal end where the elongate antenna elements are coupled respectively to the inner and outer feeder structure conductors.

20. An antenna according to claim 19, wherein the average axial electrical length of the sleeve is at least approximately equal to $\lambda/4$ of the centre of the opening frequency range.

21. A dielectric-loaded loop antenna for operation at frequencies above 200 MHz comprising an elongate cylindrical core having a relative dielectric constant greater than 5, and an antenna element structure on the core outer surface comprising a pair of diametrically opposed elongate antenna elements and annularly arranged linking conductors, the elongate elements extending from a feed connection at one end of the core to the linking conductors, wherein the elongate elements are each bifurcated to define, in combination with the linking conductors, two looped conductive paths of different lengths coupled to the feed connection and having different electrical resonant frequencies.

22. An antenna according to claim 21, wherein the linking conductors are arranged to provide an isolated virtual ground for the bifurcated parts of the elongate elements, and the bifurcation of each elongate element is positioned such that the electrical lengths of the bifurcated parts produce a voltage to current transformation at the respective resonant frequencies of the loop.

23. An antenna according to claim 21, wherein the ends of the elongate elements lie substantially in a common plane containing the core axis.

24. A handheld radio communication unit having a radio transceiver, an integral earphone for directing sound energy from an inner face of the unit which, in use, is placed against the user's ear, and an antenna as claimed in claim 1, wherein the first and second ends of the elongate antenna elements lie generally in a common plane and the antenna is mounted in the unit such that the common plane lies generally parallel to the inner face of the unit so that a null in the radiation pattern exists in the direction of the user's head.

25. A dielectric-loaded loop antenna for operation at frequencies above 200 MHz comprising an elongate dielectric core formed of a solid material having a relative dielectric constant greater than 5 and, on or adjacent the surface of the core, a three-dimensional antenna element structure including at least a pair of laterally opposed elongate antenna elements which extend between longitudinally spaced-apart positions on the core, and at least one linking conductor extending around the core to interconnect the said elements of the pair, the elongate elements having respective first ends coupled to a feed connection and second ends coupled to at least one said linking conductor, wherein the said elongate elements and the linking conductor or conductors together form at least two looped conductive paths each extending from the feed connection to a location spaced lengthwise of the core from the feed connection, then around the core, and back to the feed connection, the electrical length of one of the two paths being greater than that of the other path and extending around the core on the opposite side thereof from the other path, wherein said linking conductor comprises a conductive sleeve encircling the core, the elongate elements of said pair being connected at their respective second ends to a rim of the sleeve to provide first and second conductive linking paths between the elongate elements around respective opposite sides of the core, and wherein the rim is stepped such that the first linking path extends around one side of the core substantially at a first longitudinal location and the second linking path extends around the other side of the core substantially at a different, second longitudinal location.

26. An antenna according to claim 25, wherein said first and second ends of said elongate elements lie generally in a common plane.

27. An antenna according to claim 26, including a feeder structure extending longitudinally through the core from a distal end of the core to a proximal end thereof, the feeder structure providing the feed connection to the core distal end and being coupled at the core proximal end to the conductive sleeve to form a ground connection for the sleeve, wherein the electrical length of the sleeve is at least approximately equal to $\lambda/4$ at an operating frequency of the antenna, where n is an odd number integer.

28. A dielectric-loaded loop antenna for operation at frequencies above 200 MHz comprising a dielectric core having a central axis and formed of a solid material having a relative dielectric constant greater than 5 and, on or adjacent the surface of the core, a three-dimensional antenna element structure including first and second elongate parts which are laterally opposed with respect to each other and which each comprise at least two mutually adjacent and generally parallel elongate conductors extending between axially spaced-apart positions on the core, and linking conductors extending around the core to interconnect said elongate parts, said elongate parts having respective first ends coupled to a feed connection and second ends coupled to the linking conductors, wherein said first and second elongate parts and said linking conductors together form at least two looped conductive paths each extending from the feed connection to a location spaced lengthwise of the core from the feed connection, then around the core, and back to the feed connection, the electrical length of one of the two paths being greater than that of the other of the two paths at an operating frequency of the antenna.

29. An antenna according to claim 28, having a single pair of said laterally opposed elongated antenna element structure parts, each of said elongate parts being forked so as to have a divided portion which extends from a location between said first and second ends to said second end and which is formed by said mutually adjacent conductors.

30. An antenna according to claim 28, wherein the mutually adjacent conductors of at least one of said elongate parts have different electrical lengths.

31. An antenna according to claim 28, wherein said first and second ends of said elongate antenna element structure parts lie generally in a common plane.

32. An antenna according to claim 28, including a conductive sleeve, and a feeder structure extending axially through the core from a distal end of the core to a proximal end thereof, the feeder structure providing the feed connection at the core distal end and being coupled at the core proximal end to the conductive sleeve to form a ground connection for the sleeve.

33. An antenna according to claim 32, wherein the electrical length of the sleeve is at least approximately equal to $\lambda/4$ at a operating frequency of the antenna, wherein n is an odd number integer.

34. An antenna according to claim 32, wherein the elongate antenna element structure parts are coupled to a distal rim of the sleeve, which rim constitutes at least one of said linking conductors.

35. An antenna according to claim 28, including a conductive sleeve, and a feeder structure extending axially through the core from a distal end of the core to a proximal end thereof, the feeder structure providing the feed connection at the core distal end and being coupled at the core proximal end to the conductive sleeve to form a ground connection for the sleeve, wherein the elongate antenna element structure parts are coupled to the sleeve, and wherein each of said parts has mutually adjacent generally parallel conductors one of which is connected to the distal rim of a first part of the sleeve to form a linking path around one side of the core and another of which is connected to the distal rim of a second part of the sleeve to form a linking path around the other side of the core, the first and second parts of the sleeve being separated from one another over at least part of their longitudinal extent by a pair of longitudinally extending slits in the conductive material of the sleeve.

36. An antenna according to claim 28, wherein the core is substantially cylindrical and each side elongate antenna element structure part is helical, executes p half turns around the core, where p is an integer, and the mutually adjacent conductors of each said elongate part comprise parallel helical conductors.

37. An antenna according to claim 36, further comprising a coaxial feeder structure passing through the core on its central axis from a proximal end to a distal end of the core, wherein the linking conductors are formed by a longitudinally split conductive sleeve connected to the outer conductor of the feeder structure at the core proximal end and having a distal rim connected to said mutually adjacent conductors, the feeder structure providing said feed connection at the core distal end where the elongate antenna elements are coupled respectively to the inner and outer feeder structure conductors.

38. An antenna according to claim 37, wherein the average axial electrical length of the sleeve is at least approximately equal to $\lambda/4$ at the centre of the operating frequency range.

39. A dielectric-loaded loop antenna for operation at frequencies above 200 MHz comprising a cylindrical core having a relative dielectric constant greater than 5, and an antenna element structure on the cylindrical outer surface of the core comprising a pair of diametrically opposed elongate conductor groups and an annular linking conductor arrangement, the elongate conductor groups extending from a feed connection at one end of the core to the linking conductor arrangement, wherein the conductor groups each include at least two mutually adjacent and parallel conductors, the at least two mutually adjacent and parallel conductors of both elongate conductor groups being arranged in combination with the linking conductor arrangement to define at least two looped conductive paths of different electrical lengths coupled to the feed connection and having different electrical resonant frequencies.

40. An antenna according to claim 39, wherein the linking conductor arrangement is adapted to provide an isolated virtual ground for said mutually adjacent conductors.

41. An antenna according to claim 39, wherein each of the conductor groups follows a respective helical path and has ends which lie substantially in a common plane containing the core axis.

42. A handheld radio communication unit, the handheld radio communication unit comprising:

a radio transceiver, an integral earphone for directing sound energy from an inner face of the unit which, in use, is placed against an ear of a user; and an antenna comprising:

a dielectric core having a central axis and formed of a solid material having a relative dielectric constant greater than 5 and, on or adjacent the surface of the core, a three-dimensional antenna element structure including first and second elongate parts which are laterally opposed with respect to each other and which each comprise at least two mutually adjacent and generally parallel elongate conductors extending between axially spaced-apart positions on the core, and linking conductors extending around the core to interconnect said elongate parts, said elongate parts having respective first ends coupled to a feed connection and second ends coupled to the linking conductors, wherein said first and second elongate parts and said linking conductors together form at least two looped conductive paths each extending from the feed connection to a location spaced lengthwise of the core from the feed connection, then around the core, and back to the feed connection, the electrical length of one of the two paths being greater than that of the other path at an operating frequency of the antenna, and wherein the first and second ends of the elongate antenna element structure parts lie generally in a common plane and the antenna is mounted in the unit such that the common plane lies generally parallel to the inner face of the unit so that a null in the radiation pattern exists in the direction of the user's head.

* * * * *

UNITED STATES PATENT AND TRADEMARK OFFICE

CERTIFICATE OF CORRECTION

PATENT NO. : 6,184,845 B1
DATED : February 6, 2001
INVENTOR(S) : Oliver P. Leisten et al.

It is certified that error appears in the above-identified patent and that said Letters Patent is hereby corrected as shown below:

Column 11,
Line 23, delete "and linking conductors extending around the core to interconnect the elongate elements of the pair, the elongate elements of said pair having respective first ends coupled to a feed connection"

Signed and Sealed this

Twenty-ninth Day of October, 2002

*Attest:*

*Attesting Officer*

JAMES E. ROGAN
*Director of the United States Patent and Trademark Office*